United States Patent [19]

Mayes

[11] 4,170,217

[45] Oct. 9, 1979

[54] ANDIRONS HAVING REAR END LOCKING MEANS

[76] Inventor: C. C. Mayes, P.O. Box 8, Pigeon Forge, Tenn. 37863

[21] Appl. No.: 813,849

[22] Filed: Jul. 8, 1977

[51] Int. Cl.[2] ..... F24B 7/00; F24B 13/00

[52] U.S. Cl. ..... 126/121; 126/164; 126/201; 126/298

[58] Field of Search ..... 126/298, 201, 202, 203, 126/336, 164, 153 B, 138, 139, 140, 141, 120, 121

[56] References Cited

U.S. PATENT DOCUMENTS

| | | | |
|---|---|---|---|
| 979,195 | 12/1910 | Parrish | 126/298 |
| 2,161,194 | 6/1939 | Plym | 126/298 |
| 4,074,681 | 2/1978 | Whiteley | 126/164 |

FOREIGN PATENT DOCUMENTS

| | | | |
|---|---|---|---|
| 735350 | 8/1955 | United Kingdom | 126/164 |

*Primary Examiner*—Dennis L. Taylor
*Attorney, Agent, or Firm*—Fitch, Even, Tabin & Luedeka

[57] ABSTRACT

An andiron system, for use in a fireplace comprising a floor, a front wall defining an opening, a rear wall, a pair of oppositely disposed side walls and a chimney, includes ledge means fixedly secured between the side walls at a location adjacent the rear wall. The ledge includes an upper surface spaced above the floor to which a pair of spaced apart elongated channel means are fixedly secured. The system also includes a pair of andirons, each comprising a forward leg member resting upon the floor and an elongated generally horizontal member, including a first end and a second end. The first end of the horizontal member is attached to the leg member and the second end is nonpivotally received in the channel means to restrain the andirons from moving laterally relative to one another and the fireplace.

3 Claims, 6 Drawing Figures

ANDIRONS HAVING REAR END LOCKING MEANS

The presently disclosed invention relates generally to the field of fireplaces, stoves and other fire-containing enclosures and more specifically to an andiron system for holding logs during burning.

In the field of fireplaces it is common to provide a pair of spaced-apart andirons within a fireplace. Each andiron commonly includes an elongated vertical member, a first end of which is expanded and rests upon the floor of the fireplace to support one end of the andiron above the floor of the fireplace, and a horizontal member which supports logs in elevated positions. The horizontal member is maintained at a level above the floor by having its other end attached to an upright member, i.e. a leg, which leg rests upon the floor. The expanded vertical member rests upon the floor over an expanded area which is not colinear with the area of the horizontal member leg which rests upon the floor. Thus, the andiron is firmly maintained in an upright position.

However, the andirons are free to slide about the fireplace floor both relative to one another and/or relative to their desired positions, which can prove quite troublesome. As an operator places logs upon the andirons, it is desirable for the andirons to remain stationary. Frequently, logs are heavy and fireplaces require awkward movements because the operator must reach through the opening to lift and adjust the logs and/or andirons. Therefore, it is generally desirable to be able to place a log properly on the first effort. Unfortunately, independently movable andirons are easily bumped out of position.

Another time when it is desirable for the andirons to remain stationary, particularly relative to one another, is when the operator attempts to adjust burning logs as with a poker. Andirons which freely spread apart allow burning logs to tumble from their elevated positions and roll across the fireplace floor, even rolling out into the room to cause serious damage.

Contrarily, however, it is desirable for the andirons to be removable for easy removal of ashes and other cleaning operations, etc.

It is therefore an object of the present invention to provide an improved andiron system. It is an additional object to provide an andiron system in which each of the andirons is essentially stationary, yet each is removable from the fireplace. Other objects and advantages will become apparent through reference to the description and accompanying drawings in which.

Figure 1:
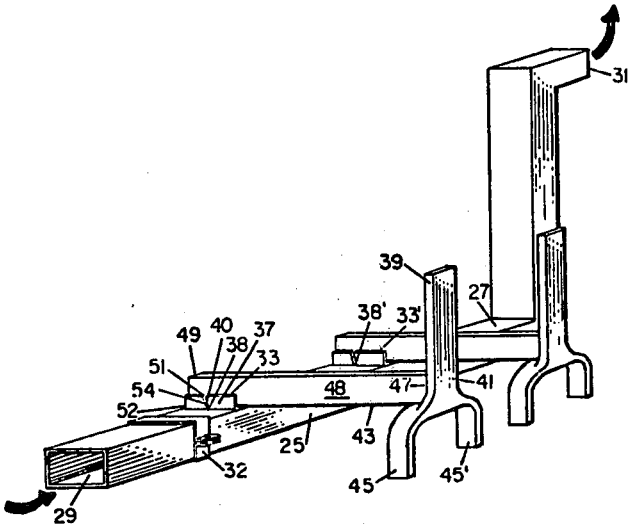
FIG. 1 is a perspective view of an andiron system embodying various features of the presently disclosed system.
Figure 4:
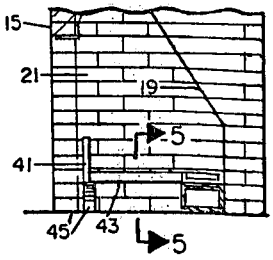
FIG. 4 is a plan view, partially in section, taken along line 4—4 in FIG. 3.
Figure 2:
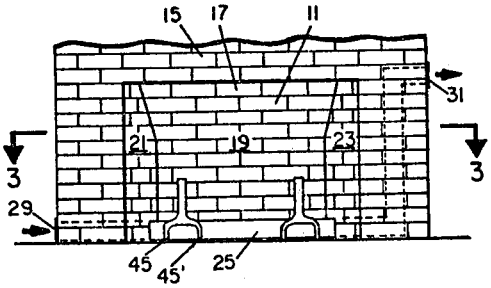
FIG. 2 is a plan view of an andiron system embodying various features of the presently disclosed system.
Figure 5:
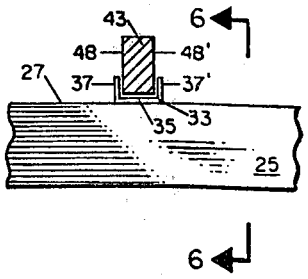
FIG. 5 is a plan view, partially in section, taken along line 5—5 in FIG. 4.
Figure 3:
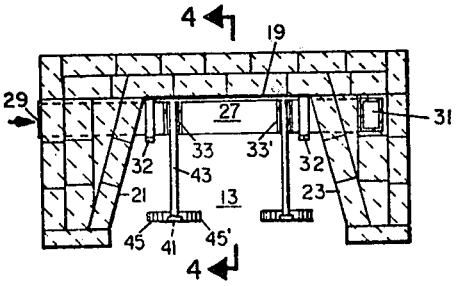
FIG. 3 is a plan view, partially in section, taken along line 3—3 in FIG. 2.
Figure 6:
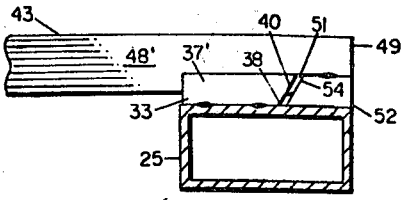
FIG. 6 is a plan view, partially in section, taken along line 6—6 in FIG. 5.

Generally, the disclosed andiron system includes, in combination with a fireplace comprising a floor, a front wall defining an opening, a rear wall disposed opposite the front wall, a pair of oppositely disposed side walls and a chimney, means extending transversely across the fireplace opening between the side walls and adjacent the rear wall of the fireplace defining an upper surface spaced above the floor, a pair of spaced-apart, elongated channel means fixedly attached to the ledge upper surface and a pair of andirons. Each andiron comprises a front support, e.g. a leg, and an elongated generally horizontal member including a first end and a second end. The first end of the horizontal member is fixedly attached to the leg and the second end is adapted to be received in the channel means in a manner such that the andirons are restrained from moving laterally relative to one another and from sliding forwardly toward the front opening of the fireplace.

Referring to the drawings, a fireplace 11 comprises a floor 13, a front wall 15, defining an opening 17, a rear wall 19 disposed opposite the front wall and a pair of oppositely disposed side walls 21 and 23. The walls preferably are constructed from firebrick or other heat-resistant material.

As shown in the Figures, disposed within the fireplace 11 proximate to the rear wall 19 there is a ledge 25 which includes an upper surface 27 that extends transversely of the fireplace opening between the side walls 21 and 23 at a location adjacent the rear wall 19. In a preferred embodiment, the ledge 25 comprises a removable central portion of a heat exchanging conduit which provides flow communication between an inlet 29 and an outlet 31, such that the upper surface 27 is fixed relative to the side walls 21 and 23 and the rear wall 19. The inlet 29 is located at the floor level of the room adjoining the fireplace to draw in cool air. The outlet 31 exhausts into the adjoining room at a level above the inlet. Air within the conduit is heated by fire within the fireplace and naturally rises to the outlet 31. A negative air pressure develops at the inlet 29. Thus, a continuous air flow is maintained. The conduit central portion is removably held in place by clamps 32. Removable attachment permits fast and easy replacement, which is required occasionally because of heat deterioration of the metal.

Secured upon the ledge upper surface 27 are a pair of spaced apart, elongated channel means 33 and 33', each being generally U-shaped in cross-section and comprising a base wall 35 and a pair of parallel, perpendicularly upstanding side walls 37 and 37'. The respective axes of the channel means 33 and 33' are generally perpendicular to the front wall 15, and spaced apart a distance less than a typical log, or about 40 cm. As will be described more fully hereinafter, the side walls 37 and 37' of each of the channels 33 and 33' are spaced apart a distance adapted to receive a portion of the horizontal member of an andiron. The rearward edges 38 and 38' of the side walls 37 and 37' are undercut, i.e. the edges 38 and 38' form acute angles with the upper surface 27, to define a downwardly and forwardly sloping surface 40.

Also disposed within the fireplace 11 are a pair of spaced-apart andirons 39. (Only one andiron will be described in detail because each one of the pair is essentially identical to the other and performs identical functions.) Each andiron 39 comprises an elongated front leg 41 and an elongated horizontal member 43. One end of the leg 41 is expanded to form two legs 45 and 45' which rest upon the fireplace floor 13. The areas of contact of the legs 45 and 45' with the floor 13 form a line generally parallel to the ledge 25.

A first end 47 of the horizontal member 43, which includes side walls 48 and 48', is attached to the leg 41 at a location approximately 15 cm above the floor 15. The opposing second end 49 of the horizontal member is received within the channel means 33. The elongated channel side walls 37 and 37' are spaced apart a distance only slightly greater than the width of the horizontal member 43. Thus, when the horizontal member is placed within the channel 33, the horizontal member is supported from below and restrained from lateral motion. Pivotal lateral motion is restrained by the elongated area over which the channel side walls 37 and 37' and horizontal member side walls 48 and 48' are juxtaposed.

Locking means 51 are included in the second end 49 of the horizontal member to prevent unintentional lifting of the second end, as happens when the andiron 39 is caused to tip forward, i.e. pivoting about the legs 45, such as when dropping fresh logs on a fire. The locking means 51 in the preferred embodiment comprises a section of channel 52 that is secured to the rear end of the horizontal member 43 and projects laterally (and downwardly preferably) therefrom to define a shoulder having a sloped forward surface 54 that is matingly received against the surface 40 on the channel 33. In a preferred embodiment, the channel means 33 and locking means 51 are cut from a single piece of channel tubing. The cut is non-perpendicular to the plane defined by the channel base, preferably forming an angle of about 45°. One portion of the cut channel tube is attached to the conduit 25, as by welding. The mating cut portion of the channel tube is attached to the underside of the horizontal member second end 49, as by welding.

Thus, the andiron 39 is locked into position by lowering a portion of the horizontal member 43 inboard of the locking means 51 into the channel means 33, then drawing the andiron toward the front wall until the locking means 51 engages the edges 38. Inasmuch as the edges 38 are fixedly attached to the ledge 25 and overlie the locking means 51, the andiron horizontal member 43 is prevented from rising out of the channel member 33. The ledge 25 and andirons 39 thus form an essentially unitary system which is stationary within the fireplace.

In the engaged position, the horizontal member 43 rests upon the ledge 25 over a substantial area. The horizontal members become quite hot by reason of being in intimate contact with the fire and composed of a heat conducting metal, such as iron. Where the ledge 25 comprises a heat exchanging conduit, substantial amounts of heat are transferred through the area of contact to increase the efficiency of the heat exchange system.

While a preferred embodiment has been shown and described it will be understood that there is no intent to limit the invention by such disclosure, but rather, it is intended to cover all modifications and alternate constructions falling within the spirit and scope of the invention as defined in the appended claims.

What is claimed is:

1. In a fireplace comprising a floor, a front wall defining an opening, a rear wall disposed opposite said front wall, a pair of oppositely disposed side walls and a chimney, an andiron system comprising means defining ledge means fixedly secured between said side walls at a location adjacent said rear wall and including an upper surface spaced above said floor, means defining first and second spaced-apart elongated channels, each of which includes an open top and which is fixedly secured to said ledge upper surface, and a pair of andirons, each andiron comprising a forward leg member resting upon said floor, an elongated generally horizontal member including a first end portion and a second end portion, said first end portion of said horizontal member being attached to said leg member and said second end portion of said horizontal member being non-pivotally received in one of said channels, and means releasably securing said second end portion of said horizontal member against movement thereof in a direction forwardly of said fireplace or in a vertical direction without prior non-vertical movement thereof whereby said andirons are restrained from moving laterally relative to one another and said fireplace.

2. A system as described in claim 1 wherein said ledge comprises a heat exchanging conduit secured to said walls, and said horizontal member contacts said conduit over a substantial area.

3. A system as described in claim 1 wherein said means securing said second end of said horizontal member comprises a downwardly and forwardly sloping rear surface of said channel means and shoulder means secured to said horizontal member second end, said shoulder means being adapted to engage said sloping rear surface of said channel means.

* * * * *